US010316868B2

(12) United States Patent
Asaba

(10) Patent No.: US 10,316,868 B2
(45) Date of Patent: Jun. 11, 2019

(54) FLUID PRESSURE CYLINDER

(71) Applicant: SMC CORPORATION, Chiyoda-ku (JP)

(72) Inventor: Tsuyoshi Asaba, Abiko (JP)

(73) Assignee: SMC CORPORATION, Chiyoda-ku (JP)

( * ) Notice: Subject to any disclaimer, the term of this patent is extended or adjusted under 35 U.S.C. 154(b) by 194 days.

(21) Appl. No.: 15/128,159

(22) PCT Filed: Feb. 12, 2015

(86) PCT No.: PCT/JP2015/054504
§ 371 (c)(1),
(2) Date: Sep. 22, 2016

(87) PCT Pub. No.: WO2015/151622
PCT Pub. Date: Oct. 8, 2015

(65) Prior Publication Data

US 2017/0097022 A1 Apr. 6, 2017

(30) Foreign Application Priority Data

Apr. 1, 2014 (JP) ..... 2014-075442
Sep. 10, 2014 (JP) ..... 2014-183756

(51) Int. Cl.
*F15B 15/14* (2006.01)
*F15B 15/28* (2006.01)

(52) U.S. Cl.
CPC ..... *F15B 15/1404* (2013.01); *F15B 15/149* (2013.01); *F15B 15/1457* (2013.01);
(Continued)

(58) Field of Classification Search
CPC ..... F15B 11/12; F15B 11/18; F15B 15/1404; F15B 15/1471; F15B 15/149
See application file for complete search history.

(56) References Cited

U.S. PATENT DOCUMENTS 5,351,603 A * 10/1994 Yuda ..... B23Q 37/00 92/128
6,336,390 B1 * 1/2002 Sato ..... F15B 15/1404 91/406
(Continued)

FOREIGN PATENT DOCUMENTS

CN 1290820 A 4/2001
DE 201 08 382 U1 9/2001
(Continued)

OTHER PUBLICATIONS

International Search Report and Written Opinion dated Jun. 3, 2015 in PCT/JP2015/054504 filed Feb. 12, 2015.
(Continued)

*Primary Examiner* — Michael Leslie
*Assistant Examiner* — Matthew Wiblin
(74) *Attorney, Agent, or Firm* — Oblon, McClelland, Maier & Neustadt, L.L.P.

(57) ABSTRACT

In a cylinder body of a fluid pressure cylinder, pistons are movably accommodated in respective cylinder holes, which are formed in a pair of main body portions. Further, a rod on which a magnet is installed is disposed movably in the axial direction in a connecting section that interconnects one of the main body portions and another of the main body portions. The rod and piston rods are connected to an end plate, whereby the rod is moved integrally with the end plate when the pistons are moved under the supply of a pressure fluid. Additionally, magnetism from the magnet is detected by a detection sensor mounted in the cylinder body, whereby the position of the pistons in the axial direction is detected.

8 Claims, 8 Drawing Sheets

(52) U.S. Cl.
CPC ..... *F15B 15/2861* (2013.01); *F15B 15/1447* (2013.01); *F15B 15/2807* (2013.01)

(56) References Cited

U.S. PATENT DOCUMENTS

| | | | | |
|---|---|---|---|---|
| 7,191,695 | B2 * | 3/2007 | Sato | F15B 15/226 92/13.7 |
| D681,164 | S | 4/2013 | Asaba | |
| 2001/0014278 | A1 * | 8/2001 | Maffeis | F15B 15/1404 414/749.1 |
| 2011/0162520 | A1 * | 7/2011 | Ishibashi | F15B 15/1404 91/508 |

FOREIGN PATENT DOCUMENTS

| | | | |
|---|---|---|---|
| JP | 03-044210 | U | 4/1991 |
| JP | 9-229016 | A | 9/1997 |
| JP | 2001-074005 | A | 3/2001 |
| JP | 2012-229760 | A | 11/2012 |
| TW | D149849 | S1 | 1/2013 |

OTHER PUBLICATIONS

Combined Chinese Office Action and Search Report dated Apr. 12, 2017, in Patent Application No. 201580017208.7 (with English translation).
Office Action dated Nov. 29, 2016 in Japanese Patent Application No. 2014-183756 (with partial English language translation).

* cited by examiner

FLUID PRESSURE CYLINDER

TECHNICAL FIELD

The present invention relates to a fluid pressure cylinder which causes a piston to be displaced in an axial direction under the supply of a pressure fluid.

BACKGROUND ART

As disclosed, for example, in Japanese Laid-Open Utility Model Publication No. 03-044210, the present applicant has proposed a fluid pressure cylinder as a means for transporting a workpiece or the like, the fluid pressure cylinder having pistons that are displaced under the supply of a pressure fluid.

The fluid pressure cylinder, for example, includes a cylinder body formed with a wide flat shape, a pair of pistons disposed for displacement in the interior of the cylinder body, piston rods that are connected respectively to the pistons, and a plate that is connected to ends of the piston rods. In addition, by supplying a fluid to cylinder chambers of the cylinder body, the pistons are moved along an axial direction, whereby the plate is moved with respect to the cylinder body in directions to approach toward and separate away from the cylinder body.

SUMMARY OF INVENTION

With the aforementioned fluid pressure cylinder, there is a demand to further reduce the size and number of components that make up the fluid pressure cylinder.

A general object of the present invention is to provide a fluid pressure cylinder in which it is possible to further reduce the size in the longitudinal dimension along the axial direction thereof, as well as to reduce the number of component parts that make up the fluid pressure cylinder.

The present invention is characterized by a fluid pressure cylinder that includes a cylinder body including a pair of cylinder chambers to which a pressure fluid is introduced, a pair of pistons disposed displaceably along the cylinder chambers, and an end plate disposed outside of the cylinder body, the end plate being disposed on ends of piston rods that are connected to the pistons. The pistons are moved along the cylinder chambers upon supply of the pressure fluid to the cylinder chambers.

In the fluid pressure cylinder, a rod is connected to the end plate substantially in parallel with the direction of movement of the pistons, the rod having a magnet on an outer circumferential surface thereof, and in the interior of the cylinder body, the rod is arranged outside of the cylinder chambers and is moved in the axial direction together with the pistons.

According to the present invention, in the fluid pressure cylinder, which includes the cylinder body having the pair of cylinder chambers and the pistons, on the end plate, which is disposed on ends of the piston rods that are connected to the pistons, the rod is disposed substantially in parallel with the direction of movement of the pistons for movement in the axial direction together with the pistons at a location outside of the cylinder chambers. The magnet is provided on the outer circumferential surface of the rod.

Consequently, by providing the magnet, which heretofore has been disposed on the pistons in the conventional fluid pressure cylinder, on a rod that is separate from the pistons, in comparison with the conventional fluid pressure cylinder, the pistons can be made smaller in size in the axial direction. Along therewith, while the amount of movement of the pistons in the axial direction is kept the same, the longitudinal dimension in the axial direction of the cylinder body can be suppressed, and thus the fluid pressure cylinder can be made smaller in size. Further, since the position of the pair of pistons can be detected by a single rod on which the magnet is provided, in contrast to the conventional fluid pressure cylinder, in which magnets are provided respectively on the pair of pistons, the number of magnets can be reduced, and thus the number of component parts that make up the fluid pressure cylinder can be reduced.

The above and other objects, features and advantages of the present invention will become more apparent from the following description when taken in conjunction with the accompanying drawings in which a preferred embodiment of the present invention is shown by way of illustrative example.

DESCRIPTION OF EMBODIMENTS

Figure 1:
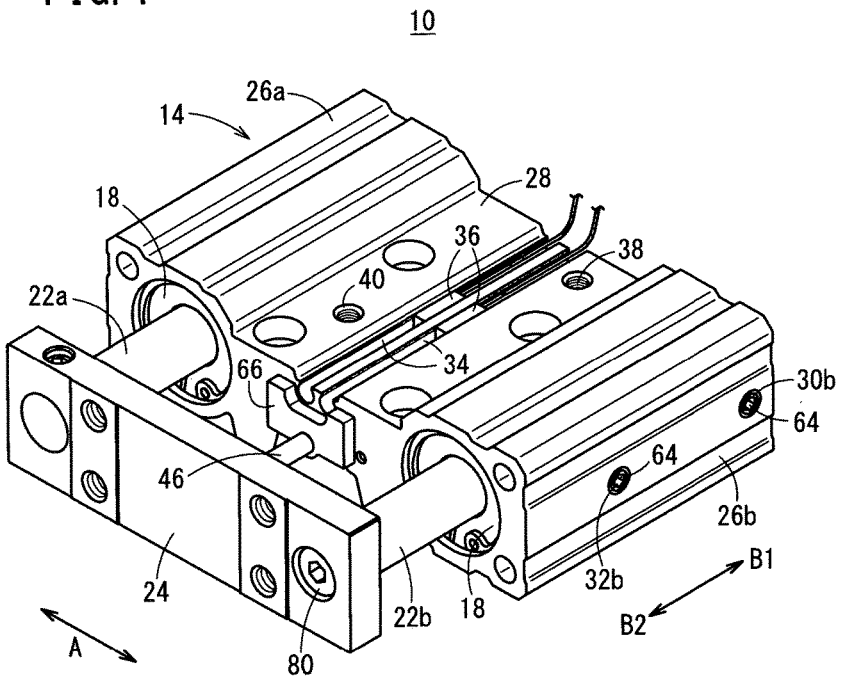
FIG. 1 is an exterior perspective view of a fluid pressure cylinder according to a first embodiment of the present invention.

As shown in FIGS. 1 through 4, a fluid pressure cylinder 10 includes a cylinder body 14 formed with a flattened shape in cross-section and having in the interior thereof a pair of cylinder holes (cylinder chambers) 12*a*, 12*b*, a pair of head covers 16 that are mounted in ends of the cylinder holes 12*a*, 12*b*, a pair of rod covers 18 mounted in other ends of the cylinder holes 12*a*, 12*b*, a pair of pistons 20*a*, 20*b* disposed for displacement along the cylinder holes 12*a*, 12*b*, a pair of piston rods 22*a*, 22*b* connected respectively to centers of the pistons 20*a*, 20*b*, and an end plate 24 that is connected to ends of the piston rods 22*a*, 22*b*.

The cylinder body 14 is formed, for example, by extrusion molding from a metal material, and has a pair of main body portions 26*a*, 26*b* that are separated a predetermined distance from each other in a widthwise direction (the direction of the arrow A), and a connecting section 28 that interconnects one of the main body portions 26*a* and another of the main body portions 26*b*. More specifically, as shown in FIGS. 3 and 4, the cylinder body 14 is formed in a symmetrical shape in which the main body portions 26*a*, 26*b* are formed respectively on both sides in the widthwise direction about the connecting section 28, which is disposed centrally in the widthwise direction of the cylinder body 14.

Figure 2:
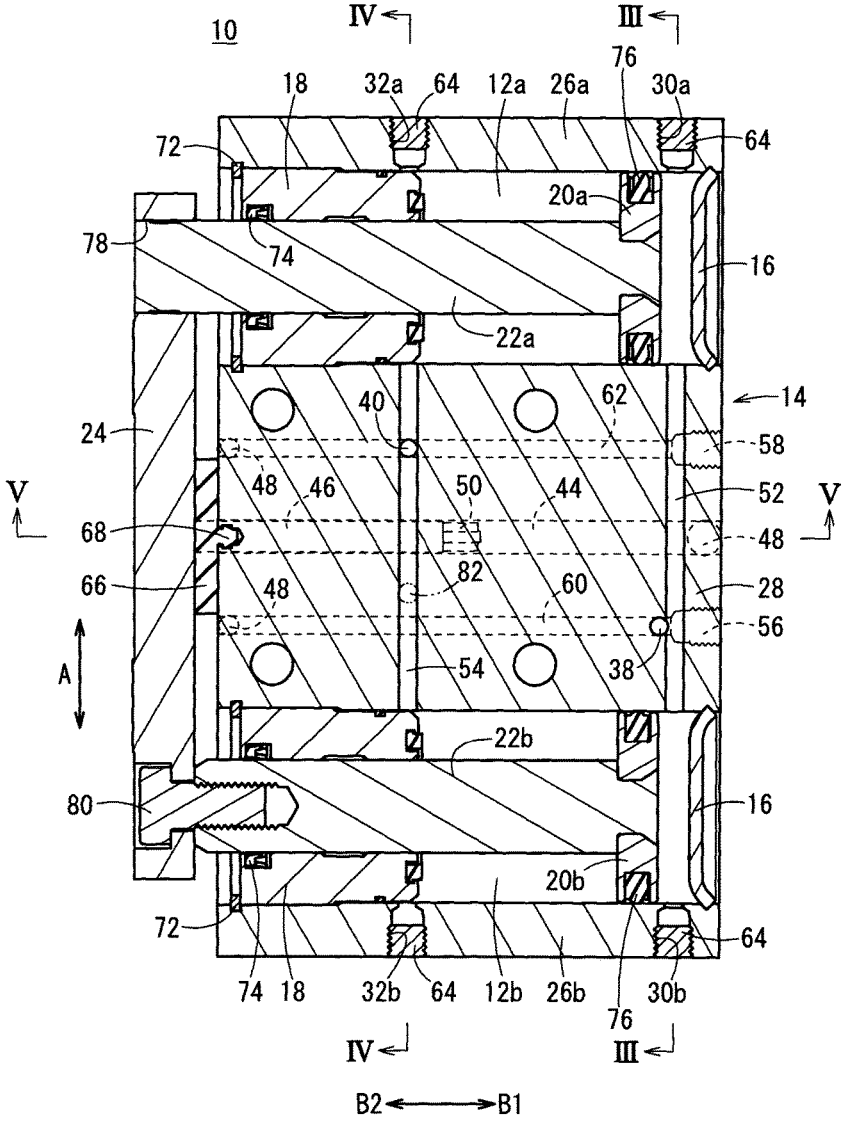
FIG. 2 is an overall vertical cross-sectional view of the fluid pressure cylinder shown in FIG. 1.

The main body portions 26*a*, 26*b* are formed, for example, with substantially rectangular shapes in cross-section, and the cylinder holes 12*a*, 12*b*, which are circular in cross-section, penetrate in the axial direction (the direction of arrows B1, B2) substantially in the centers of the main body portions 26*a*, 26*b*. Further, on side surfaces of the main body portions 26*a*, 26*b*, as shown in FIG. 2, first side surface ports 30*a*, 30*b* and second side surface ports 32*a*, 32*b* open respectively at positions in the vicinity of one end and the other end of the cylinder body 14.

More specifically, the first side surface port 30*a* and the second side surface port 32*a* are formed as a pair in a side surface on the one main body portion 26*a*, and the first side surface port 30*b* and the second side surface port 32*b* are formed as a pair in a side surface on the other main body portion 26*b*.

Figure 3:
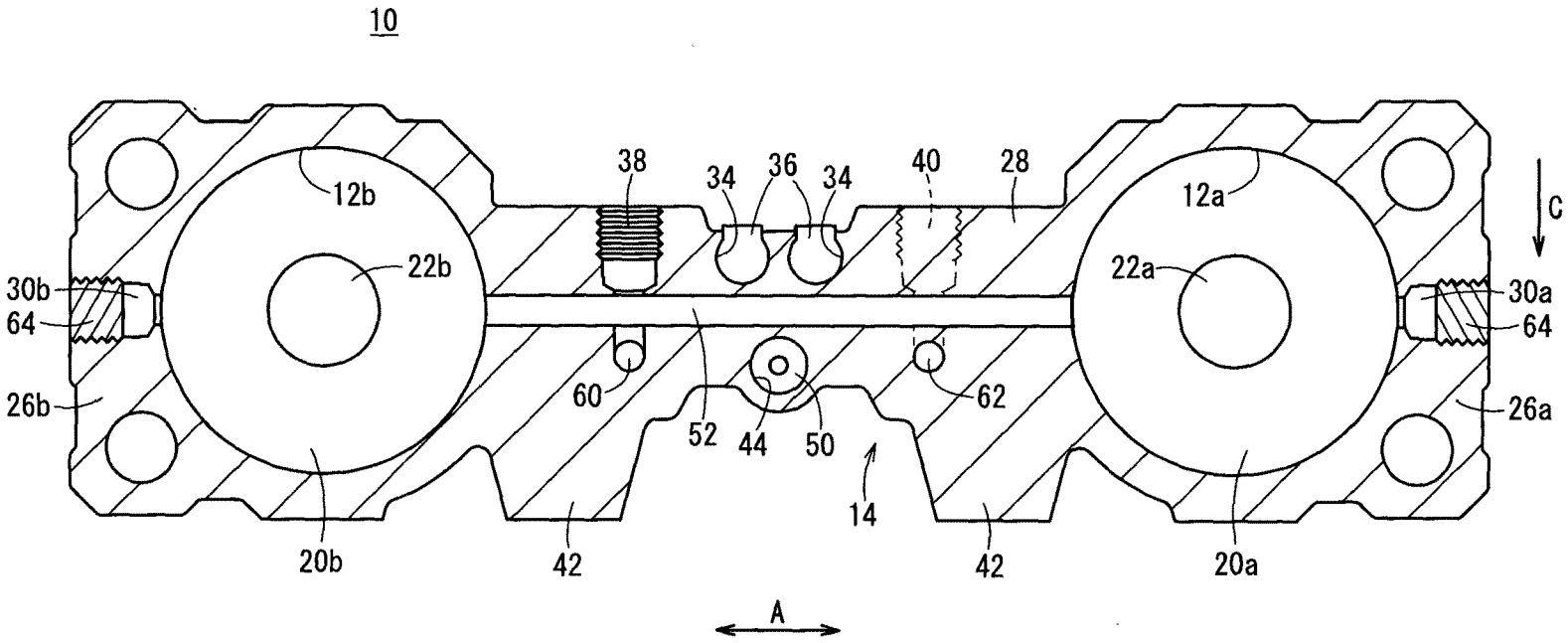
FIG. 3 is a cross-sectional view taken along line III-III of FIG. 2.
Figure 4:
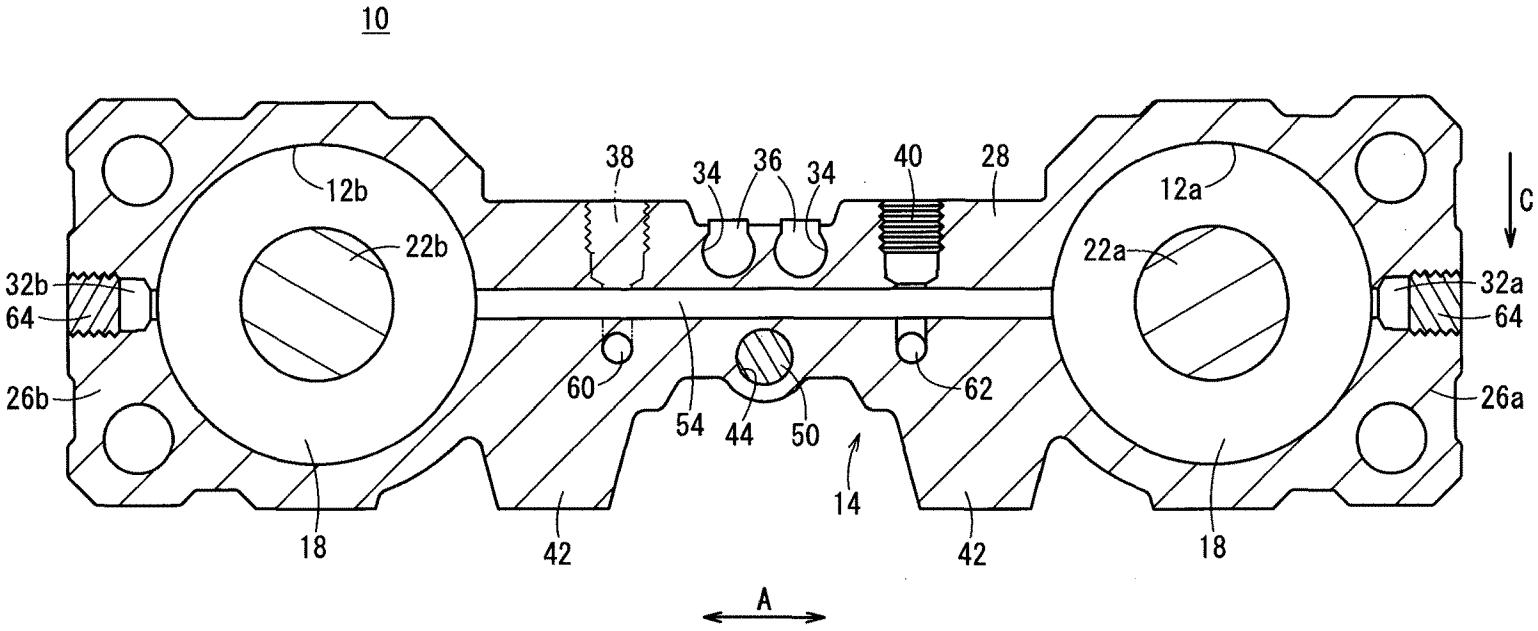
FIG. 4 is a cross-sectional view taken along line IV-IV of FIG. 2.

As shown in FIGS. 3 and 4, the upper surface of the connecting section 28 is formed in a substantially planar shape, and is recessed downwardly at a predetermined depth with respect to upper surfaces of the main body portions 26*a*, 26*b*. A pair of sensor attachment grooves 34 is formed substantially in the center in the widthwise direction of the upper surface of the connecting section 28. The sensor attachment grooves 34 are recessed with respect to the upper surface with substantially semicircular shapes in cross-section, and are formed as straight lines along the axial direction (the direction of arrows B1, B2). In addition, detection sensors 36 for detecting positions to which the pistons 20*a*, 20*b* have moved are accommodated respectively in the sensor attachment grooves 34.

Further, first and second upper surface ports 38, 40 through which the pressure fluid can be supplied and discharged are formed on the upper surface of the connecting section 28. As shown in FIG. 2, the first upper surface port 38 is disposed on a straight line along a widthwise direction (the direction of the arrow A) connecting the first side surface port 30*a* of one of the main body portions 26*a* and the first side surface port 30*b* of the other of the main body portions 26*b*. The second upper surface port 40 is disposed on a straight line along the widthwise direction (the direction of the arrow A) connecting the second side surface port 32*a* of the one main body portion 26*a* and the second side surface port 32*b* of the other main body portion 26*b*.

More specifically, the pair of first side surface ports 30*a*, 30*b* and the first upper surface port 38 are arranged on a straight line along the widthwise direction of the cylinder body 14, and the pair of second side surface ports 32*a*, 32*b* and the second upper surface port 40 also are arranged on a straight line along the widthwise direction of the cylinder body 14.

Further, as shown in FIGS. 3 and 4, on a lower part of the connecting section 28, a pair of legs 42 are formed that bulge outwardly in a downward direction (the direction of the arrow C). Lower surfaces of the legs 42 are formed in a flat shape, and are substantially coplanar with the lower surfaces of the main body portions 26*a*, 26*b*. In addition, the fluid pressure cylinder 10 is mounted stably by placing the lower surfaces of the main body portions 26*a*, 26*b* and the legs 42 of the connecting section 28 in abutment, for example, against a floor surface or the like.

Figure 5:
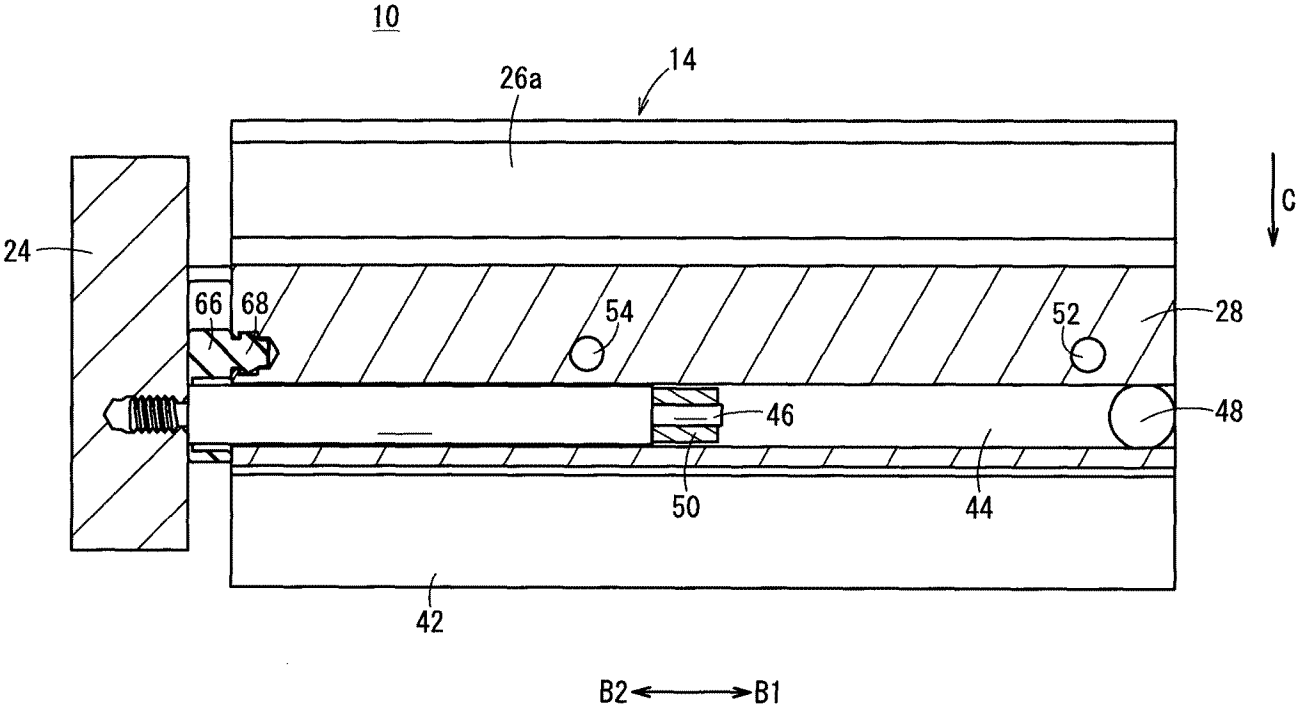
FIG. 5 is a cross-sectional view taken along line V-V of FIG. 2.

On the other hand, as shown in FIGS. 3 through 5, a through hole 44 that penetrates in the axial direction (the direction of arrows B1, B2) is formed in the interior of the connecting section 28 at a substantially central position in the widthwise direction, and a rod 46, which is connected to the end plate 24, is inserted into the through hole 44. As shown in FIG. 2, the through hole 44 is formed substantially in parallel with the cylinder holes 12*a*, 12*b* and the sensor attachment grooves 34. The through hole 44 is sealed by a ball 48 that is pressed into one end side (in the direction of the arrow B1) thereof.

The rod 46 is made up from a shaft, which is formed, for example, with a circular shape in cross-section, and with a predetermined length in the axial direction (the direction of arrows B1, B2). The rod 46 is arranged substantially in parallel with the piston rods 22*a*, 22*b*. A magnet 50, which serves as a detecting body, is mounted through an annular groove on an outer circumferential surface on one end of the rod 46. The magnet 50, for example, is formed in a cylindrical shape having a predetermined length in the axial direction (the direction of arrows B1, B2) of the rod 46, and is installed so as to cover the outer circumferential side of the one end of the rod 46. Further, the other end of the rod 46 is connected by threaded engagement with the end plate 24, as will be described later (see FIG. 5).

In addition, when the rod 46 is moved along the axial direction (the direction of arrows B1, B2), magnetism from the magnet 50, which is disposed on the one end thereof, is detected by the detection sensors 36, which is mounted on the upper surface of the connecting section 28. As a result, the movement position in the axial direction (the direction of arrows B1, B2) of the pistons 20*a*, 20*b*, which are connected to the end plate 24 together with the rod 46, is detected.

More specifically, by detecting the position of the rod 46 that moves together with the pistons 20*a*, 20*b*, the position of the pistons 20*a*, 20*b* can also be detected.

Further, in the interior of the connecting section 28, as shown in FIGS. 2 through 4, a pair of first and second communication passages 52, 54 are formed in the widthwise direction (the direction of the arrow A) thereof. The first communication passage 52 and the second communication passage 54 are separated from each other by a predetermined distance in the axial direction (the direction of arrows B1, B2) of the cylinder body 14, and provide communication mutually between one of the cylinder holes 12*a* and the other of the cylinder holes 12*b* in the cylinder body 14.

The first communication passage 52 is disposed in the vicinity of the head covers 16 on one end side (in the direction of the arrow B1) of the cylinder body 14, and is formed along a straight line with the first side surface ports 30*a*, 30*b*. The second communication passage 54 is disposed in the vicinity of the rod covers 18 on the other end side (in the direction of the arrow B2) of the cylinder body 14, and is formed along a straight line with the second side surface ports 32*a*, 32*b*.

On the other hand, as shown in FIG. 2, on one end of the connecting section 28, first and second rear surface ports 56, 58 are formed through which the pressure fluid can be supplied and discharged. The first rear surface port 56 is connected to a first penetrating passage 60 that penetrates in the axial direction (the direction of arrows B1, B2) through the connecting section 28, and the second rear surface port 58 is connected to a second penetrating passage 62 that penetrates in the axial direction (the direction of arrows B1, B2) through the connecting section 28. The first and second penetrating passages 60, 62 are formed substantially in parallel and are separated a predetermined distance from each other. Other ends of the first and second penetrating passages 60, 62 are sealed by balls 48.

In addition, the first penetrating passage 60 communicates through the first upper surface port 38 with the first communication passage 52, and the second penetrating passage 62 communicates through the second upper surface port 40 with the second communication passage 54.

More specifically, in the cylinder body 14, there are included a total of eight ports made up from the first side surface ports 30*a*, 30*b* and the second side surface ports 32*a*, 32*b*, which are provided on the side surfaces of the pair of main body portions 26*a*, 26*b*, the first and second upper surface ports 38, 40, which are provided on the upper surface of the connecting section 28, and the first and second rear surface ports 56, 58, which are provided on the one end of the connecting section 28.

In addition, when the pistons 20*a*, 20*b* are moved toward the rod cover 18 (in the direction of the arrow B2), pressure fluid is supplied selectively to any one of the first side surface ports 30*a*, 30*b*, the first upper surface port 38, and the first rear surface port 56. On the other hand, when the pistons 20*a*, 20*b* are moved toward the head covers 16 (in the direction of the arrow B1), pressure fluid is supplied selectively to any one of the second side surface ports 32*a*, 32*b*, the second upper surface port 40, and the second rear surface port 58.

A pressure fluid supply source is connected, for example, through non-illustrated tubes, to any of the aforementioned pair of first side surface ports 30*a*, 30*b*, the pair of second side surface ports 32*a*, 32*b*, the first and second upper surface ports 38, 40, or the first and second rear surface ports 56, 58, and the pressure fluid is supplied through the ports to the cylinder holes 12*a*, 12*b*. Further, the ports that are not used and to which tubes are not connected (i.e., in the present embodiment, the first side surface ports 30*a*, 30*b* and the second side surface ports 32*a*, 32*b*, and the first and second rear surface ports 56, 58) are closed by installation of sealing plugs 64 therein.

More specifically, among the eight ports made up from the first side surface ports 30*a*, 30*b* and the second side surface ports 32*a*, 32*b*, the first and second upper surface ports 38, 40, and the first and second rear surface ports 56, 58, any two of the ports are used selectively depending on the installation environment or layout of tubes, etc., which is used for the fluid pressure cylinder 10, whereas the other six ports, other than the two used ports, are closed by installing the sealing plugs 64 therein.

On the other hand, a damper 66, which, for example, is made of an elastic material, is mounted in facing relation to the end plate 24 on the other end of the connecting section 28. The damper 66 is formed in a flat plate-like shape projecting a predetermined height with respect to the other end of the connecting section 28, and the damper 66 is fixed to the cylinder body 14 by a projection 68 formed in a center region thereof being press-fitted into a recess of the cylinder body 14. In addition, when the end plate 24 is moved toward the cylinder body 14 (in the direction of the arrow B1), by abutment of the end plate 24 against the damper 66, shocks and impact sounds are reduced.

As shown in FIG. 2, the head covers 16 are made, for example, from disk-shaped plate bodies, which are inserted into the cylinder holes 12*a*, 12*b* from the one end side (in the direction of the arrow B1) of the cylinder body 14. In addition, in the cylinder holes 12*a*, 12*b*, by the head covers 16 being pressed and expanded in diameter by a non-illustrated tool such as a jig or the like, the outer edges thereof bite into and engage with the inner circumferential surfaces of the cylinder holes 12*a*, 12*b*. Further, the outer edges of the head covers 16 are inclined in a direction toward the one end side (in the direction of the arrow B1) of the cylinder body 14.

Each of the rod covers 18, for example, is formed in a cylindrical shape having a rod hole defined through the center thereof. The rod covers 18 are inserted respectively from the other end sides (in the direction of the arrow B2) of the cylinder holes 12*a*, 12*b*, and are fixed in the interiors of the cylinder holes 12*a*, 12*b* by locking rings 72, which are engaged with the inner circumferential surfaces of the cylinder holes 12*a*, 12*b*. Rod packings 74 are disposed through annular grooves on inner circumferential surfaces of the rod holes.

The pistons 20*a*, 20*b* are formed, for example, in disk-like shapes having a predetermined thickness. Piston packings 76 are mounted in annular grooves that are formed on outer circumferential surfaces of the pistons 20*a*, 20*b*. In addition, the pistons 20*a*, 20*b* are accommodated respectively in the interiors of the cylinder holes 12*a*, 12*b*, such that the pistons 20*a*, 20*b* are movable along the axial direction (the direction of arrows B1, B2) in a state in which the piston packings 76 abut against inner circumferential surfaces of the cylinder holes 12*a*, 12*b*.

The piston rods 22*a*, 22*b* are constituted from shafts having predetermined lengths in the axial direction (the direction of arrows B1, B2). Ends of the piston rods 22*a*, 22*b* are inserted through piston holes, which penetrate through the centers of the pistons 20*a*, 20*b*, and are joined by caulking with respect to the pistons 20*a*, 20*b*. Consequently, the pistons 20*a*, 20*b* are connected to the ends of the piston rods 22*a*, 22*b*.

Further, the other ends of the piston rods 22*a*, 22*b* are disposed so as to project outwardly from the cylinder body 14 after having been inserted through the rod holes of the rod cover 18. At this time, the rod packings 74, which are mounted on the rod cover 18, are placed in sliding contact with the outer circumferential surfaces of the piston rods 22*a*, 22*b*, whereby leakage of pressure fluid from between the piston rods 22*a*, 22*b* and the rod covers 18 is prevented.

The end plate 24, for example, is formed with a rectangular shape in cross-section having a predetermined width. One end in the widthwise direction (the direction of the arrow A) of the end plate 24 is connected with one of the piston rods 22*a* that is inserted through a hole 78, and the other end in the widthwise direction (the direction of the arrow A) of the end plate 24 is connected by a bolt 80 with respect to the other of the piston rods 22*b*. More specifically, the end plate 24 is connected with respect to the other ends of the pair of piston rods 22*a*, 22*b* perpendicularly to the axial direction of the piston rods 22*a*, 22*b*. Further, the height of the end plate 24 is formed to be of substantially the same height or slightly lower in height than the height of the main body portions 26*a*, 26*b* of the cylinder body 14 (see FIG. 5).

The fluid pressure cylinder 10 according to the first embodiment of the present invention is constructed basically as described above. Next, operations and advantages of the fluid pressure cylinder 10 will be described. The condition shown in FIG. 2, in which the pistons 20*a*, 20*b* are moved to the one end side (in the direction of the arrow B1) of the cylinder body 14, will be treated as an initial condition. Further, in this state, a case will be described in which pressure fluid is supplied and discharged through the first and second upper surface ports 38, 40 of the cylinder body 14.

First, in the initial position shown in FIG. 2, by supply of the pressure fluid to the first upper surface port 38 through a tube from the non-illustrated pressure fluid supply source, the pressure fluid passes through the first communication passage 52 and is introduced respectively to the pair of cylinder holes 12*a*, 12*b*. In this case, the second upper surface port 40 is in a state of being open to atmosphere.

By the pressure fluid that is introduced to the pair of cylinder holes 12*a*, 12*b*, the pistons 20*a*, 20*b* are pressed toward the other end side (in the direction of the arrow B2) of the cylinder body 14, along with the piston rods 22*a*, 22*b* and the end plate 24 being moved together in unison. More specifically, by movement of the pistons 20*a*, 20*b* toward the other end side of the cylinder body 14, as shown in FIG. 6, the end plate 24 is moved in a direction (the direction of the arrow B2) away from the cylinder body 14.

Figure 6:
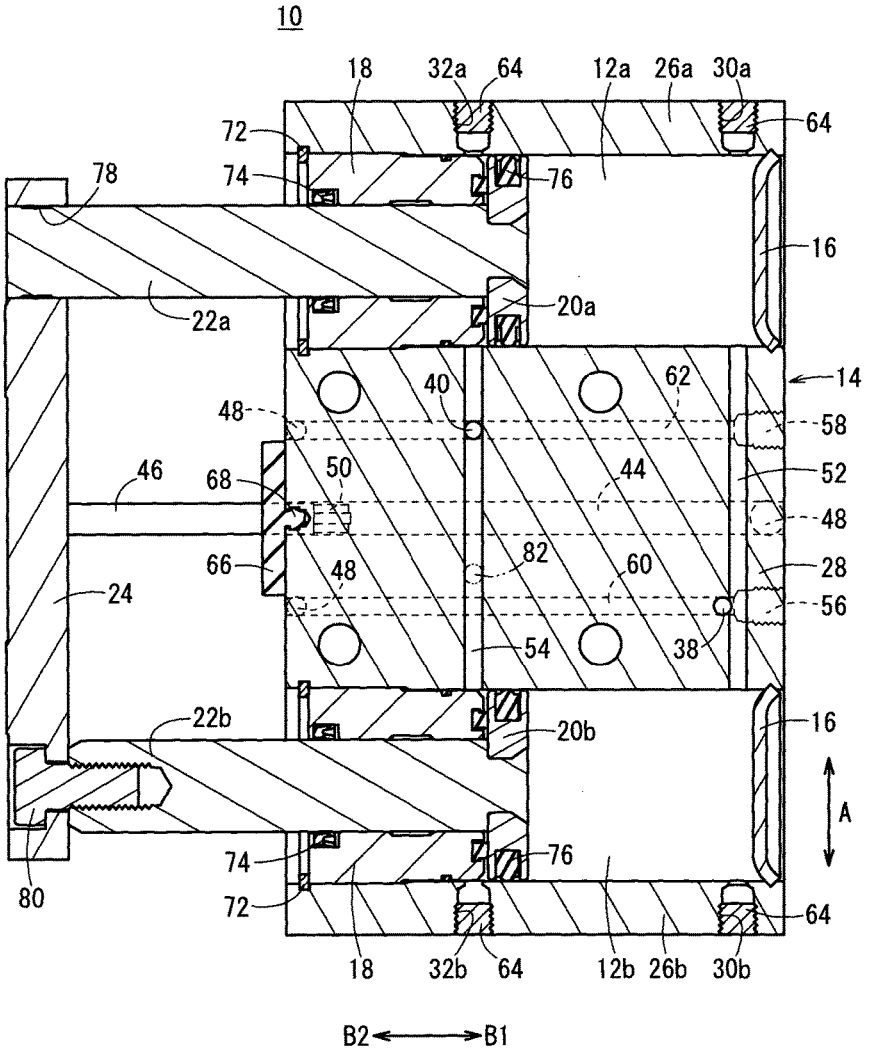
FIG. 6 is an overall vertical cross-sectional view showing a condition in which an end plate of the fluid pressure cylinder of FIG. 2 is moved in a direction away from the cylinder body.

In addition, as shown in FIG. 6, the pair of pistons 20*a*, 20*b* come into abutment respectively against the ends of the rod covers 18, so that a displacement end position is reached.

On the other hand, in the case that the end plate 24 is moved to approach again toward the cylinder body 14 (in the direction of the arrow B1), under a switching operation of a non-illustrated switching means, the pressure fluid which had been supplied to the first upper surface port 38 is supplied instead to the second upper surface port 40 from the pressure fluid supply source. In this case, the first upper surface port 38 is placed in a state of being open to atmosphere.

The pressure fluid supplied to the second upper surface port 40 passes through the second communication passage 54, and is introduced between the rod covers 18 and the pistons 20*a*, 20*b* in the pair of cylinder holes 12*a*, 12*b*, whereby the two pistons 20*a*, 20*b* are pressed respectively toward the head covers 16 (in the direction of the arrow B1). As a result, the piston rods 22*a*, 22*b* are moved so as to become accommodated gradually inside the cylinder holes 12*a*, 12*b*, along with the end plate 24 being moved to approach toward the other end of the cylinder body 14. In addition, as shown in FIG. 2, the end plate 24 comes into abutment against the damper 66 that is mounted on the cylinder body 14, so that the initial position is restored.

Next, in the aforementioned fluid pressure cylinder 10, a case will be described in which only one of the pistons 20*a* is pressed under the supply of a pressure fluid, at the time of a returning operation to restore the pistons 20*a*, 20*b* to the one end side (in the direction of the arrow B1) of the cylinder body 14.

In this case, for example, midway in the second communication passage 54, a communication switching mechanism 82 (shown by the two-dot-and-dashed line in FIGS. 2 and 6) is provided. The communication switching mechanism 82 blocks communication via the second communication passage 54 when the pistons 20*a*, 20*b* are moved to the side of the head covers 16 (in the direction of the arrow B1), and the communication switching mechanism 82 also switches the second communication passage 54 to a communicating state at the time of a pressing operation in which the pistons 20*a*, 20*b* are moved to the side of the rod covers 18 (in the direction of the arrow B2).

More specifically, the communication switching mechanism 82 is arranged at a position on the side of the cylinder hole 12*b* relative to the center in the longitudinal direction of the second communication passage 54. Further, instead of providing the sealing plug 64, a filter or the like, which is permeable to air, may be disposed in the second side surface port 32*b* on the side of the main body portion 26*b*, so as to keep the second side surface port 32*b* open to atmosphere.

As the communication switching mechanism 82, for example, a check valve is used, which is installed in facing relation to the flow path of the second communication passage 54, and is capable of allowing flow of fluid in one direction only, while blocking flow of the fluid in the opposite direction. More specifically, the check valve operates to block flow of the pressure fluid to the cylinder hole 12*b* from the second upper surface port 40, yet allows flow of the pressure fluid to the second upper surface port 40 from the cylinder hole 12*b*.

First, in the case that the pistons 20*a*, 20*b* are moved to the side of the rod covers 18 (in the direction of the arrow B2), under a switching action carried out by the communication switching mechanism 82, communication is established between one of the cylinder holes 12*a* and the other of the cylinder holes 12*b* through the second communication passage 54. Therefore, air that is pressed by the pistons 20*a*, 20*b* toward the rod covers 18 is discharged to the exterior from the second communication passage 54 and through the second upper surface port 40.

On the other hand, at the time of a returning operation to move the pistons 20*a*, 20*b* to the side of the head covers 16 (in the direction of the arrow B1), since communication between the one of the cylinder holes 12*a* and the other of the cylinder holes 12*b* through the second communication passage 54 is blocked by the communication switching mechanism 82, by supplying pressure fluid from the second upper surface port 40, the pressure fluid that has been introduced to the second communication passage 54 is in turn introduced only to the one cylinder hole 12*a*, but is not introduced to the other cylinder hole 12*b*.

Therefore, only the piston 20*a*, which is disposed in one of the cylinder holes 12*a*, is pressed toward the head cover 16 (in the direction of the arrow B1), and the piston rod 22*a* and the end plate 24 are moved together therewith. In addition, since the piston 20*b*, which is disposed in the other of the cylinder holes 12*b*, is not pressed by the pressure fluid, the piston 20*b* is pressed together with the piston rod 22*b* toward the one end side by the end plate 24. At this time, atmospheric air is introduced to the cylinder hole 12*b* through the second side surface port 32*b*, thereby keeping the cylinder hole 12*b* at atmospheric pressure.

In the foregoing manner, for example, during the returning operation of the fluid pressure cylinder 10, in which there is no need for a strong thrust force, by supplying the pressure fluid to only the one cylinder hole 12*a* and pressing the piston 20*a*, compared to the case of supplying pressure fluid respectively to the pair of cylinder holes 12*a*, 12*b* to thereby operate both of the pistons 20*a*, 20*b*, the thrust force is cut roughly in half and the consumption of the pressure fluid can be reduced by half.

As a result, by providing, in the second communication passage 54, the communication switching mechanism 82 that switches a state of communication between the cylinder holes 12*a*, 12*b*, the thrust force is maintained at the time of carrying out the pushing operation for pushing the end plate 24 in a direction to separate away from the cylinder body 14, while the consumption amount of the pressure fluid is reduced during the returning operation when the end plate 24 is returned to the side of the cylinder body 14. Therefore, energy conservation in the fluid pressure cylinder 10 can be promoted.

In the foregoing manner, according to the first embodiment, in a fluid pressure cylinder 10 having the pair of pistons 20*a*, 20*b* and the pair of piston rods 22*a*, 22*b*, the magnet 50 for detecting the movement position of the pistons 20*a*, 20*b* is disposed on the rod 46 which is a separate body apart from the pistons 20*a*, 20*b* and which is movable in the axial direction (the direction of arrows B1, B2) of the cylinder body 14. Stated otherwise, the magnet 50 is disposed outside of the cylinder holes 12*a*, 12*b* in which the pistons 20*a*, 20*b* are accommodated. Therefore, in comparison with the conventional fluid pressure cylinder in which magnets are disposed on outer circumferential surfaces of the pistons, the pistons 20*a*, 20*b* can be reduced in thickness along the axial direction of the pistons 20*a*, 20*b*.

As a result, while the same amount of movement (stroke length) of the pistons 20*a*, 20*b* is assured, the longitudinal dimension in the axial direction of the cylinder body 14 can be suppressed, so that a reduction in longitudinal size along the axial direction of the fluid pressure cylinder 10 is made possible.

Further, since the position of the pair of pistons 20*a*, 20*b* can be detected by the single rod 46 (magnet 50), in contrast to the conventional fluid pressure cylinder, in which magnets for position detection are provided respectively on the pair of pistons, the number of magnets 50 can be reduced, and thus the number of component parts and assembly steps that make up the fluid pressure cylinder can be reduced, together with enabling a reduction in manufacturing costs.

Furthermore, the ports, which are capable of supplying and discharging the pressure fluid, are disposed on the cylinder body 14 in four directions, i.e., on both sides (the first side surface ports 30*a*, 30*b* and the second side surface ports 32*a*, 32*b*), on the upper surface (the first and second upper surface ports 38, 40), and on the one end side (the first and second rear surface ports 56, 58) in the axial direction. Therefore, taking into consideration the installation environment in which the fluid pressure cylinder 10 is used, or the layout of tubes that are connected to the ports, ports that are easiest to use can be selected and used appropriately. As a result, freedom of layout can be enhanced when the fluid pressure cylinder 10 is installed.

Further still, since it is unnecessary for the magnet 50 to be of a shape corresponding to the shape (outer diameter) of the pistons 20*a*, 20*b*, by using the common rod 46 in fluid pressure cylinders 10 having pistons 20*a*, 20*b* of differing shapes, the magnet 50 can be used in common with various types of fluid pressure cylinders 10.

As a result, in contrast to the conventional fluid pressure cylinder in which different magnets are set respectively for fluid pressure cylinders having differently shaped pistons, by making it possible for a single magnet 50 to be used, the cost required for the magnet 50 can significantly be reduced, together with simplifying component settings.

Still further, unlike the conventional fluid pressure cylinder, it is unnecessary to change the thickness of the pistons when changing the length in the axial direction (the direction of arrows B1, B2) of the magnet 50 provided on the rod 46, and the detection range by the detection sensors 36 can easily be changed simply by changing the shape of the rod 46. More specifically, in the case that the detection range by the detection sensors 36 is to be expanded, for example, by arranging two of the magnets 50 in the axial direction of the rod 46, the detection range can roughly be doubled.

Further, since on the cylinder body 14, the upper surface of the connecting section 28 is recessed downwardly (in the direction of the arrow C) with respect to the upper surfaces of the pair of main body portions 26*a*, 26*b*, for example, when tubes are connected via non-illustrated tube fittings to the first and second upper surface ports 38, 40 of the connecting section 28, the amount by which the tube fittings project in the heightwise direction can be suppressed. Therefore, the height dimension of the fluid pressure cylinder 10 including the tube fittings can suitably be suppressed.

Figure 7:
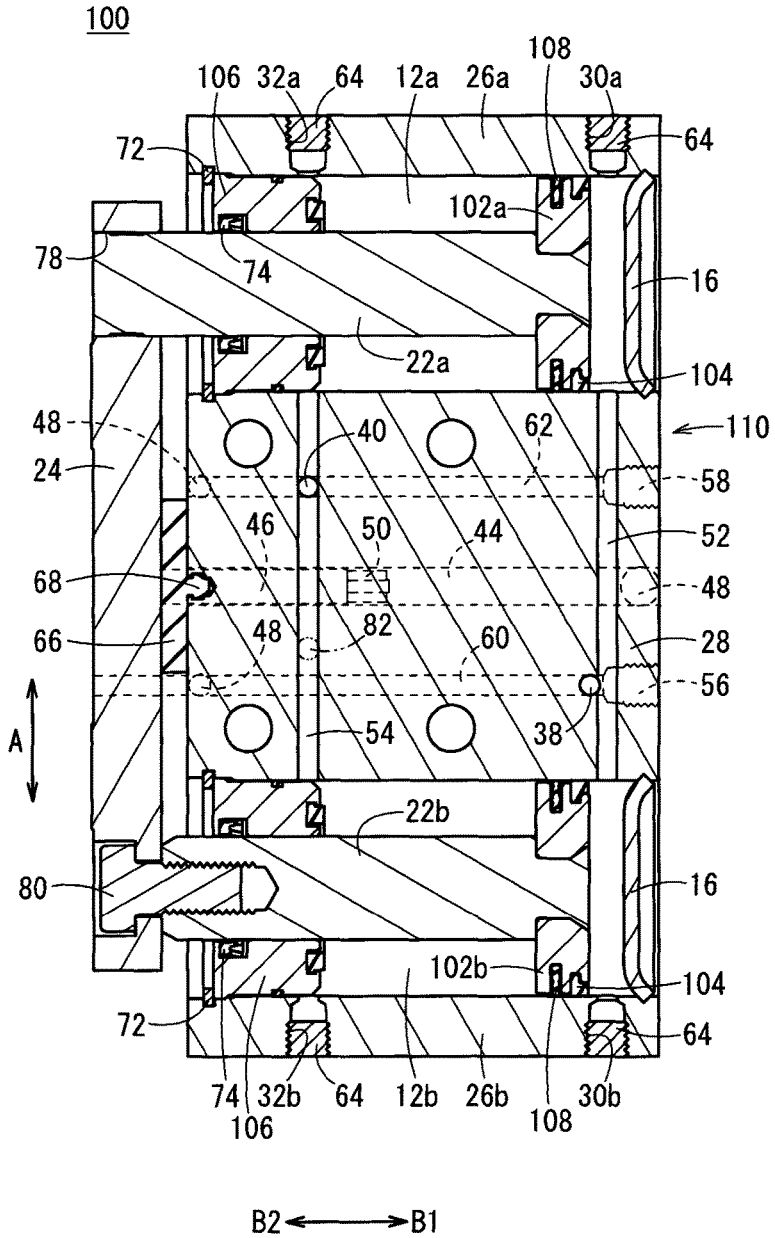
FIG. 7 is an overall vertical cross-sectional view of a fluid pressure cylinder according to a second embodiment of the present invention.
Figure 8:
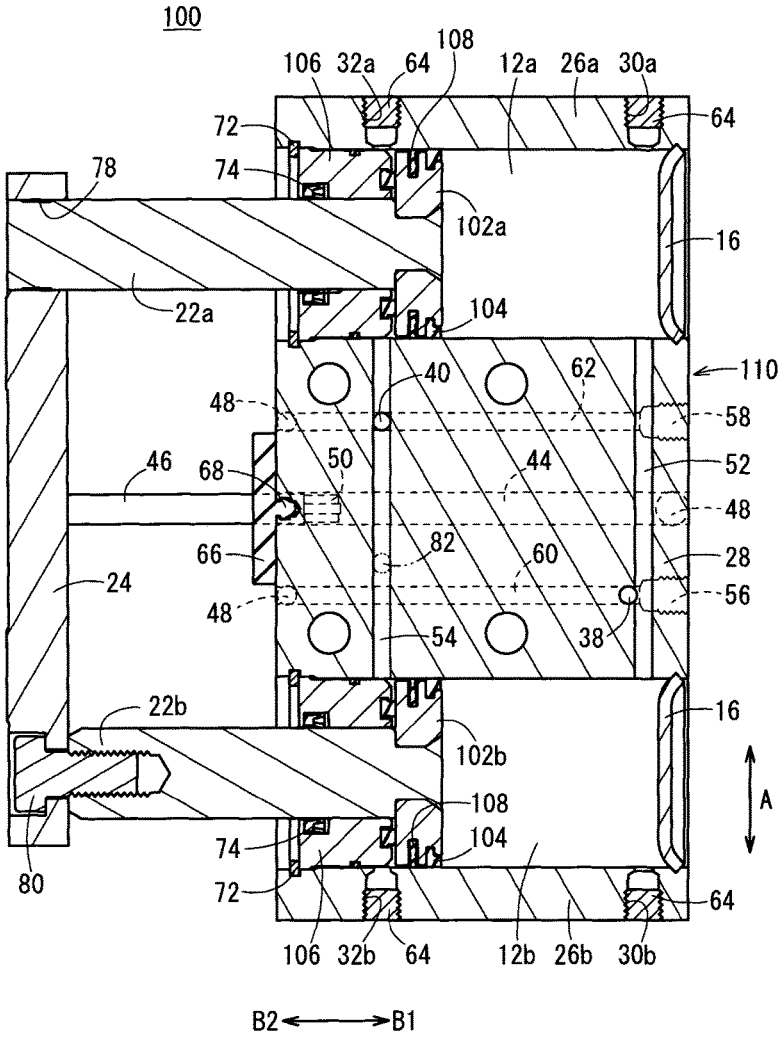
FIG. 8 is an overall vertical cross-sectional view showing a condition in which an end plate of the fluid pressure cylinder of FIG. 7 is moved in a direction away from the cylinder body.

Next, a fluid pressure cylinder 100 according to a second embodiment is shown in FIGS. 7 and 8. Constituent elements, which are the same as those of the above-described fluid pressure cylinder 10 according to the first embodiment, are denoted by the same reference characters, and detailed description of such features is omitted.

The fluid pressure cylinder 100 according to the second embodiment differs from the fluid pressure cylinder 10 according to the first embodiment, in that wear rings 104 are provided on outer circumferential surfaces of pistons 102*a*, 102*b*, and in that the length of rod covers 106 in the axial direction (the direction of arrows B1, B2) is shortened.

In the fluid pressure cylinder 100, as shown in FIGS. 7 and 8, a pair of annular grooves are formed on the outer circumferential surface of each of the pistons 102*a*, 102*b*. A wear ring 104 is installed in one of the annular grooves that is positioned on the side of the head cover 16 (in the direction of the arrow B1), whereas a piston packing 108 is installed in another of the annular grooves that is positioned on the side of the rod cover 106 (in the direction of the arrow B2). The wear ring 104 and the piston packing 108 are separated mutually by a predetermined distance in the axial direction of the pistons 102*a*, 102*b*.

The wear rings 104 are formed in an annular shape from a resin material, for example, and are disposed in sliding contact with inner circumferential surfaces of the cylinder holes 12*a*, 12*b*. The pistons 102*a*, 102*b* are guided displaceably along the cylinder holes 12*a*, 12*b* by the wear rings 104. More specifically, by providing the wear rings 104, the pistons 102*a*, 102*b* can be displaced with high precision along the axial direction.

Further, by placing the piston packings 108 in sliding contact against the inner circumferential surfaces of the cylinder holes 12*a*, 12*b*, leakage of pressure fluid from between the pistons 102*a*, 102*b* and the cylinder holes 12*a*, 12*b* is prevented.

The rod covers 106, for example, are formed with a length which is roughly one-third (⅓) the length of the rod covers 18 of the fluid pressure cylinder 10 according to the aforementioned first embodiment. Along with shortening the length dimension of the rod covers 106, the length dimension of the cylinder body 110 can also be shortened.

More specifically, by positioning the ends of the rod covers 106 that face toward the head covers 16 at the same position as the ends of the rod covers 18 in the aforementioned fluid pressure cylinder 10, without changing or affecting the stroke length along the axial direction (the direction of arrows B1, B2) of the pistons 102*a*, 102*b*, the length dimension from the other end side of the cylinder body 110 to the one end side on the side of the head covers 16 (in the direction of the B1) can be made shorter.

In the foregoing manner, according to the second embodiment, the lengths of the rod covers 106 that guide the piston rods 22*a*, 22*b* in the axial direction are shortened, and the rod covers 106 are arranged without changing the position of the end surfaces thereof that face toward the pistons 102*a*, 102*b*. Thus, the length dimension of the cylinder body 110 can be minimized without changing the stroke length of the pistons 102*a*, 102*b* along the axial direction.

Further, the wear rings 104 are disposed on outer circumferential surfaces of the pistons 102*a*, 102*b*, and as a result of being constructed to be capable of guiding the pistons 102*a*, 102*b* in the axial direction, even though the lengths of the rod covers 106 in the axial direction are shortened and thus the guiding capability of the piston rods 22*a*, 22*b* is diminished, due to the presence of the wear rings 104, the ability to guide the pistons 102*a*, 102*b* can be enhanced. Therefore, the ability for the pistons 102*a*, 102*b* and the piston rods 22*a*, 22*b* in the fluid pressure cylinder 100 to advance and retract straight in the axial direction can be maintained with high precision.

The fluid pressure cylinder according to the present invention is not limited to the embodiments described above, and various alternative or additional structures may be adopted therein without departing from the scope of the invention as set forth in the appending claims.

The invention claimed is:

1. A fluid pressure cylinder comprising:

a cylinder body including a pair of cylinder hydrostatic pressure chambers to which a pressure fluid is introduced;

a pair of pistons disposed displaceably along the cylinder hydrostatic pressure chambers; and an end plate disposed outside of the cylinder body, the end plate being disposed on ends of piston rods that are connected to the pistons, the pistons being moved along the cylinder hydrostatic pressure chambers when the pressure fluid is supplied to the cylinder hydrostatic pressure chambers, wherein a rod is connected to the end plate so that the rod is substantially in parallel with a direction of movement of the pistons, the rod having a magnet on an outer circumferential surface thereof, and disposed in an interior of the cylinder body where no hydrostatic pressure is introduced, and wherein the rod is provided outside any of the pair of cylinder hydrostatic pressure chambers and is moved in an axial direction together with the pistons.

2. The fluid pressure cylinder according to claim 1, the cylinder body further comprising:

a pair of main body portions, each including one of the pair of cylinder hydrostatic pressure chambers therein, the main body portions being separated mutually by a predetermined distance substantially in parallel with each other; and a connecting section, which extends perpendicularly to a direction of extension of the main body portions, and interconnects one of the main body portions and another of the main body portions, wherein, as viewed in cross-section perpendicular to an axial direction of the main body portions, a height dimension of the connecting section is less than a height dimension of the main body portions.

3. The fluid pressure cylinder according to claim 1, wherein ports through which the pressure fluid is supplied to and discharged from the cylinder hydrostatic pressure chambers are provided in the cylinder body, and at least two or more pairs of the ports are disposed in respective different side surfaces in the cylinder body, and supply and discharge of the pressure fluid supplied to and discharged from the cylinder hydrostatic pressure chamber is carried out selectively with respect to one of the pairs of ports.

4. The fluid pressure cylinder according to claim 3, wherein a side surface in which the ports are provided is disposed on one end of the cylinder body in the axial direction.

5. The fluid pressure cylinder according to claim 1, wherein a pair of communication passages, which communicate between one of the cylinder hydrostatic pressure chambers and another of the cylinder hydrostatic pressure chambers, are provided in the cylinder body, and a communication switching mechanism is provided in one of the communication passages through which the pressure fluid flows when the end plate is made to approach toward the cylinder body, the communication switching mechanism being configured to switch a state of communication between the one cylinder hydrostatic pressure chamber and the other cylinder hydrostatic pressure chamber through the one communication passage.

6. The fluid pressure cylinder according to claim 5, wherein the communication switching mechanism is a check valve which is mounted facing the communication passage and which is configured to allow flow of fluid in only one direction along the communication passage and block flow of the fluid in an opposite direction along the communication passage.

7. The fluid pressure cylinder according to claim 1, wherein the magnet is disposed detachably with respect to the rod.

8. The fluid pressure cylinder according to claim 1, wherein wear rings are disposed on outer circumferential surfaces of the pistons, the wear rings being configured to guide the pistons along the cylinder hydrostatic pressure chambers.

* * * * *